US005320331A

United States Patent [19]

Hellman, Sr.

[11] Patent Number: 5,320,331

[45] Date of Patent: Jun. 14, 1994

[54] METHOD AND APPARATUS FOR FORMING CORRUGATIONS IN TUBING AND A CORRUGATED TUBE PRODUCED THEREBY

[76] Inventor: Robert R. Hellman, Sr., 35 Hawley Rd., Oxford, Conn. 06483

[21] Appl. No.: 833,590

[22] Filed: Feb. 10, 1992

Related U.S. Application Data

[63] Continuation of Ser. No. 592,128, Oct. 3, 1990, abandoned.

[51] Int. Cl.[5] ..... B21D 51/12

[52] U.S. Cl. ..... 267/122; 29/454; 72/370

[58] Field of Search ..... 72/367, 370, 374.6, 72/394, 396, 398, 411, 59; 29/454; 267/122

[56] References Cited

U.S. PATENT DOCUMENTS

| | | | |
|---|---|---|---|
| 1,983,468 | 12/1934 | Knab | 72/68 |
| 2,044,711 | 6/1936 | Mantle | 72/370 |
| 2,811,173 | 10/1957 | Benson | 29/454 |
| 3,233,632 | 2/1966 | Voitik | 29/454 |
| 3,277,927 | 10/1966 | Schneider | 29/454 |
| 4,453,304 | 6/1984 | Astill et al. | 29/421.1 |

FOREIGN PATENT DOCUMENTS

| | | | |
|---|---|---|---|
| 2586546 | 3/1987 | France | 72/370 |

*Primary Examiner*—Lowell A. Larson
*Attorney, Agent, or Firm*—John H. Crozier

[57] ABSTRACT

In a preferred embodiment, a method and apparatus for hydroforming thin-wall metal corrugated tubing which include first preforming the corrugated tubing in a conventional hydroforming operation of the type in which each convolution is formed separately. Semi-resilient spacers are then inserted between the sides of adjacent internal convolutions, while non-resilient washers are inserted between the sides of adjacent external convolutions. The corrugated tubing with the inserted spacers and washers is then highly compressed to the total thickness of the individual elements, with the spacers and washers controlling the radii formed at the crests and troughs of the convolutions. The resulting corrugated tubing has trough and crest radii on the order of 1½ to 2 metal thicknesses, has an extension/compression ratio of 4 or greater, and can be compressed nearly flat. The sides of the convolutions are given a sine wave shape in cross-section to distribute stresses, so that they are not concentrated at the relatively sharp radii, and to eliminate noise when the corrugated tubing is flexed.

24 Claims, 2 Drawing Sheets

METHOD AND APPARATUS FOR FORMING CORRUGATIONS IN TUBING AND A CORRUGATED TUBE PRODUCED THEREBY

This is a continuation of co-pending application Ser. No. 07/592,128 filed on Oct. 3, 1990, now abandoned.

BACKGROUND OF THE INVENTION

1. Field of the Invention.

The present invention relates to corrugated tubing generally and, more specifically, to a novel method and apparatus for making the same, the corrugated tubing produced by which offering a range of both expansion and contraction not available with conventionally manufactured corrugated tubing.

2. Background Art.

Corrugated metal tubing has utility in such varied applications as pressure and thermal sensors, seals, expansion joints and chambers, and vibration dampeners. The convolutions of the corrugated tubing are typically formed by mechanical means from welded thin-wall tubing after the tubing is formed. Such corrugated tubing is manufactured, for example, by Westport Development Manufacturing Company, Orange, Conn.

Known methods of forming corrugated tubing are of two types: hydroforming and welding. Hydroforming itself includes three methods. In one method, a thin-wall tube sealed at one end is inserted into an apparatus which includes a plurality of spaced apart annular disks, each formed of two separable sections, the disks being spaced apart a relatively large distance. Pressure is applied to the open end of the tube, thus causing the wall of the tube to bulge into the spaces between the disks. The disks are then drawn toward each other to form the corrugations and then the sections of the disks are removed. This method is relatively quick and inexpensive, but the corrugated tubing thus produced is not very uniform. A second method is a variation of the first, in which, rather than pressurizing the tube a rubber cylinder is inserted into the tube and the rubber cylinder is then compressed, thus forming the bulges between the annular disks. The latter method is typically used for very large diameter corrugated tubing. In the third method of hydroforming, the convolutions are formed one at a time by hydraulically forming a bulge between a chuck plate and a shuttle. The shuttle is then moved toward the chuck plate to form a convolution, or corrugation, having a desired crest radius at its periphery and a desired trough radius between it and an adjacent convolution. This process is repeated along the tube until the desired number of corrugations is formed.

The third method of hydroforming is described in U.S. Pat. No. 3,141,496, issued Jul. 21, 1964, to Yowell et al, titled APPARATUS AND PROCESS FOR FORMING CORRUGATIONS IN TUBING, the disclosure of which and the references cited therein are hereby made a part hereof by reference.

The welded plate method comprises forming a number of thin metallic annular disks. The disks are then put in forming dies which bend the disks so that, when the disks are stacked, alternating pairs of disks meet at either their inner or their outer peripheries. The contacting inner and outer peripheries are then welded, while using copper chill rings to prevent distortion. The disks are usually provided not flat, but with a wave-shaped cross-section, frequently a sine wave, which stretches and relieves stresses as the corrugations are flexed.

A disadvantage of the hydroformed corrugated tubing is that it cannot be compressed "flat," that is, so that the corrugated tubing is only as long as the total of the individual thicknesses of metal, without destroying the spring of the bellows. This is because at each turn of a convolution, there is an internal radius of about 10 times, or greater, the metal thickness. Hydroformed corrugated tubing, however, can be relatively easily extended from the normal position and can be used in either an expansion or compression mode.

An advantage of the welded plate method is that the plates can be compressed flat because the individual segments touch and there is no internal radius where the edges of the individual segments meet. However, the welded plate method is very costly in that it requires a high amount of labor. A further disadvantage of welded plates is that they have a very low spring rate and can only be extended from their rest position a short distance and that only with a large amount of force; consequently, it is usually used only in the compression mode. The overall extension/compression ratio of welded plates is typically on the order of about 4/1, and the size of that ratio is due primarily to compression distance. "Extension/compression ratio" as used herein means the ratio of the length of the corrugated tubing extended to its maximum extent to the length of the corrugated tubing compressed to its maximum extent.

It will be understood from the foregoing that it would be desirable to be able to use relatively inexpensive hydroforming techniques to produce corrugated tubing that has the compressibility of a welded corrugated tubing, yet does not suffer from the poor extension characteristics of welded corrugated tubing. It is not possible to simply use the hydroforming techniques described to form corrugated tubing with radii having small radii, as such would result in uncontrolled radii formation, the radii would become too sharp, radial wrinkles would form on the convolutions, and there could be crushing of the convolutions. The result of the latter would be that the corrugated tubing could not be extended from its crushed position.

Accordingly, it is a principal object of the present invention to provide hydroformed, thin-wall metallic corrugated tubing which can be compressed to a length almost equal to the total of the thicknesses of the metal of which it is formed.

Another object of the invention is to provide such corrugated tubing which can be extended from its normal position with relatively small force.

A further object of the invention is to provide such corrugated tubing which has an extension/compression ratio of 4/1 and greater.

An additional object of the invention is to provide an apparatus for making such corrugated tubing.

Yet another object of the invention is to provide a method for making such corrugated tubing.

Yet a further object of the invention is to provide such method and apparatus which are economical.

Other objects of the present invention, as well as particular features and advantages thereof, will be elucidated in, or be apparent from, the following description and the accompanying drawing figures.

SUMMARY OF THE INVENTION

The present invention achieves the above objects, among others, by providing, in a preferred embodiment, a method and apparatus for hydroforming thin-wall metal corrugated tubing which include first preforming the corrugated tubing in a conventional hydroforming operation of the type in which each convolution is formed separately. Semi-resilient spacers are then inserted between the sides of adjacent internal convolutions, while non-resilient washers are inserted between the sides of adjacent external convolutions. The corrugated tubing with the inserted spacers and washers is then highly compressed to the total thickness of the individual elements, with the spacers and washers controlling the radii formed at the crests and troughs of the convolutions. The resulting corrugated tubing has trough and crest radii on the order of 1½ to 2 metal thicknesses, has an extension/compression ratio of 4 or greater, and can be compressed nearly flat. The sides of the convolutions are given a sine wave shape in cross-section to distribute stresses, so that they are not concentrated at the relatively sharp radii, and to eliminate noise when the corrugated tubing is flexed.

BRIEF DESCRIPTION OF THE DRAWING

The invention will be better understood if reference is made to the accompanying drawing figures, in which.

DETAILED DESCRIPTION OF THE PREFERRED EMBODIMENTS

Figure 1:
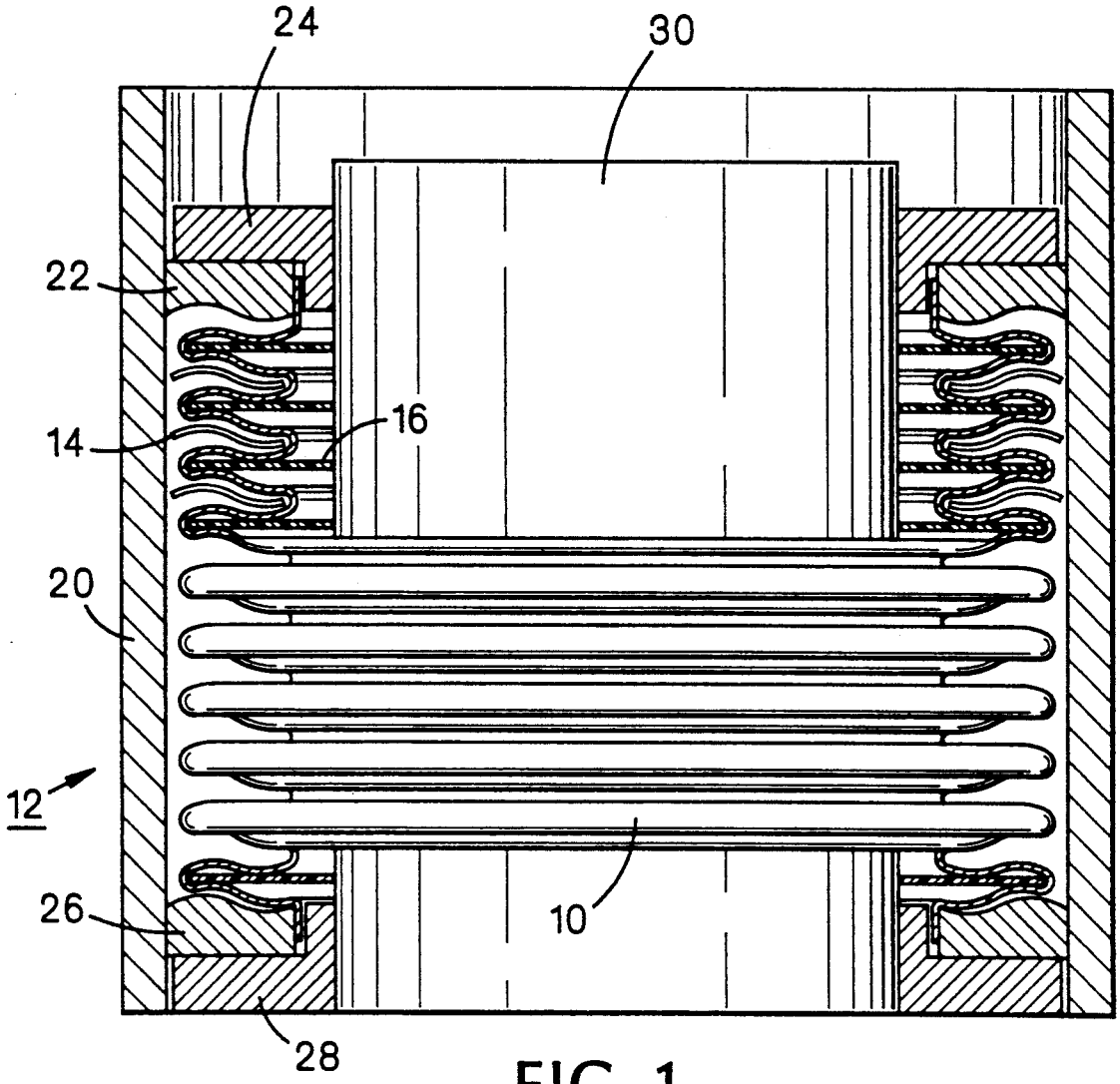
FIG. 1 is a side elevational view, partially in cross-section, of the apparatus of the present invention with a preformed corrugated tubing therein, the preformed tubing having spacers and washers inserted in the convolutions thereof.

Referring now to the Drawing, in which similar elements are given consistent identifying numerals throughout the various figures thereof, FIG. 1 illustrates a preformed corrugated tubing 10 inserted in a forming apparatus according to the present invention, generally indicated by the reference numeral 12.

Preformed corrugated metal tubing 10 has been formed to the shape shown by a conventional hydroforming technique, in particular, the technique described in the above-referenced patent. As such, it will be understood that preformed corrugated tubing 10 has internal and external radii on the order of about 10 metal thicknesses and, as formed, has certain inherent disadvantages, as noted above. For clarity, the wall thickness of tubing 10 is shown somewhat exaggerated.

Inserted between the external faces of adjacent external pairs of convolutions of preformed corrugated tubing 10 are nonresilient wave washers, as at 14, and inserted between the internal faces of adjacent pairs of internal convolutions of preformed corrugated tubing 10 are semi-resilient spacers, as at 16.

Apparatus 12 includes an annular outer sleeve 20 within which are disposed for sliding axial movement with respect thereto an annular die plate 22 and an annular spacer 24, at the upper end thereof, and an annular die plate 26 and an annular spacer 28, at the lower end thereof. Disposed centrally of annular outer sleeve 20 is a cylindrical mandrel 30 to center the foregoing elements of apparatus 12.

The upper and lower ends of corrugated tubing 10 are captured between the annular spaces formed, respectively, between die plate 22 and spacer 24 and between die plate 26 and spacer 28. Preformed corrugated tubing 10 is disposed in noncontacting relationship in the annulus formed between outer sleeve 20 and cylindrical mandrel 30.

It can be seen that the cross-sectional shapes of dies 22 and 26 and nonresilient wave washers 14 are complementary, so that those elements could be stacked together with no space therebetween.

Figure 2:
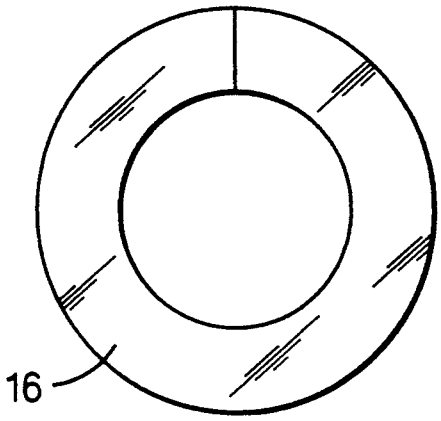
FIG. 2 is a top plan view of a semi-resilient spacer used in forming the corrugated tubing of the present invention.
Figure 3:
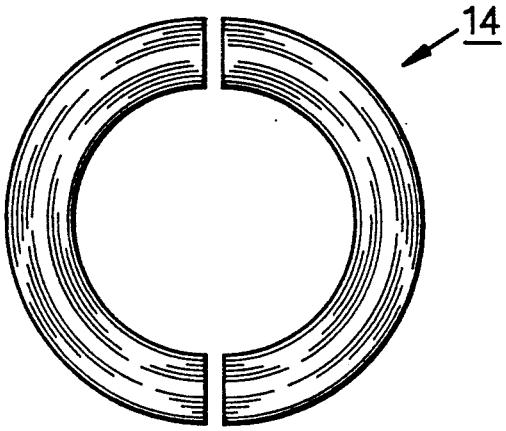
FIG. 3 is a top plan view of a non-resilient washer used in forming the corrugated tubing of the present invention.

FIG. 2 illustrates a semi-resilient spacer 16 which is noncontinuous so that it can be easily inserted into an internal convolution of preformed corrugated tubing 10. FIG. 3 illustrates a nonresilient wave washer 14 which is provided in two pieces so that it can be inserted into an external convolution of preformed corrugated tubing 10.

Figure 4:
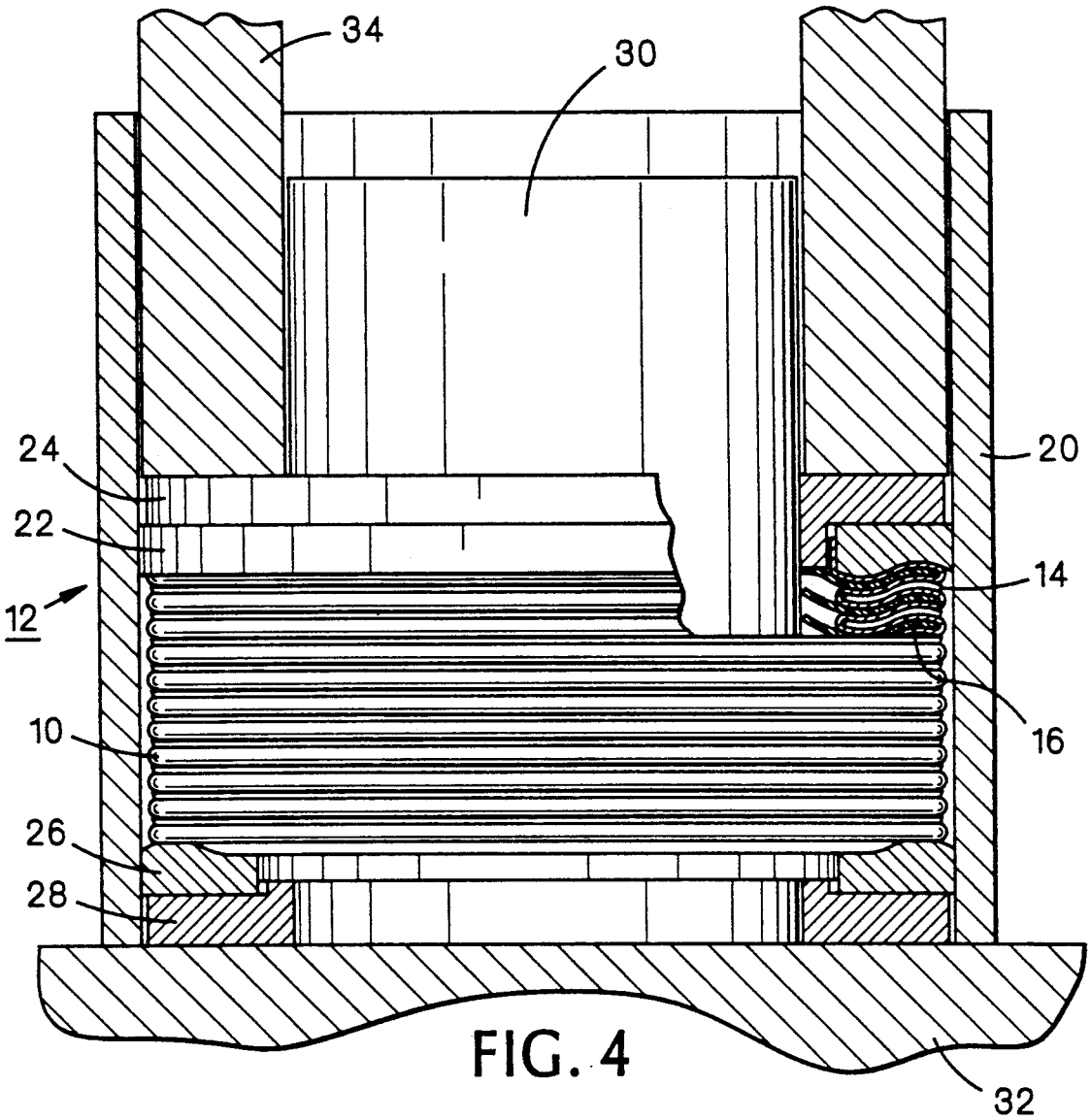
FIG. 4 is a side elevational view, partially in cross-section, of the corrugated tubing of FIG. 1 compressed.

According to the method of the present invention, preformed corrugated tubing 10 with wave washers 14 and spacers 16 inserted in the various convolutions thereof is now compressed to the total thicknesses of the walls of preformed corrugated tubing 10 and the thicknesses of washers 14 and spacers 16, as is illustrated on FIG. 4. Here, the elements shown on FIG. 1 have been placed on a flat surface 32 and a cylindrical member 34 associated with a conventional press mechanism has engaged spacer 24 and forced it downward, thus compressing preformed tubing 10 and the elements inserted therein. Because the thicknesses of the elements shown are exaggerated for clarity, the extent of compression of preformed corrugated tubing 10 is not fully indicated on FIG. 4. With, for example, preformed tubing 10 having a wall thickness of 0.005 inches, washers 14 having thicknesses of 0.015 inches each, and spacers having thicknesses of 0.010 inches each, the preformed tubing would be compressed from a natural length of 5 inches to about 1½ inches.

Figure 5:
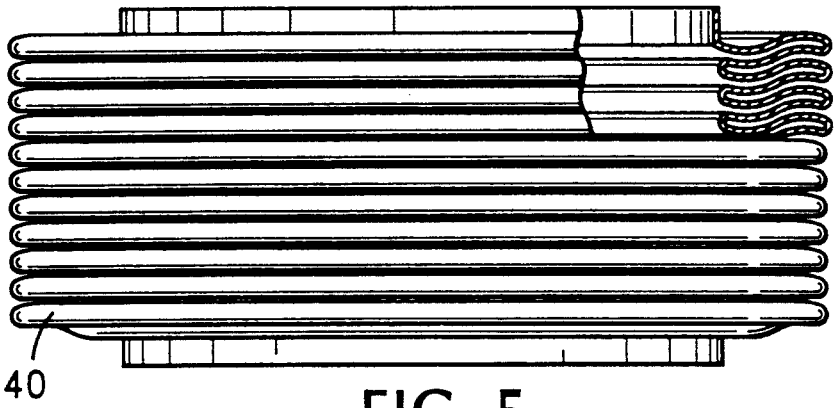
FIG. 5 is a side elevational view, partially in cross-section of a thin-wall metal corrugated tubing formed according to the present invention.

FIG. 5 illustrates preformed corrugated tubing 10, now corrugated tubing 40, after it has been removed from apparatus 12 and washers 14 and spacers 16 removed therefrom. It can be seen that the convolutions of corrugated tubing 40 have taken the shape of washers 14 and that the radii between convolutions are much less than the radii of preformed corrugated tubing 10 (FIG. 1), the former being on the order of about 1½ to 2 times the wall thickness of the tubing, as compared to 10 thicknesses for the latter. With the dimensions given above, tubing 40 will have a length of about 3.5 inches, as compared with 1½ inches for the fully compressed preformed tubing 10.

Washers 14 may be formed from any suitable hard material and semi-resilient spacers 16 are preferably formed from Teflon. The other elements of the present invention may be formed from any suitable materials known in the art.

The use of washers 14 and 16 during the compression of preformed tubing 10 permits controlled forming of trough and crest radii without the formation of sharp bends. It has been found that the compression/extension ratios of tubing formed according to the present invention is 4:1 or higher.

It will thus be seen that the objects set forth above, among those made apparent from the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A method of forming a flexible corrugated metal tubing comprising a plurality of corrugations, the transverse shape of each of said corrugations having generally a sine wave shape, comprising the steps of:

(a) providing a preformed flexible corrugated metal tubing comprising a plurality of corrugations, the transverse shape of each of said corrugations having generally a sine wave shape, and the radii of said corrugations being substantially larger than the corresponding radii of said flexible corrugated tubing;

(b) placing between the external faces of each external pair of adjacent convolutions of said flexible preformed corrugated metal tubing one of a plurality of nonresilient washers each having a sine wave shape approximating that of the corrugations of said flexible corrugated metal tubing;

(c) placing between the internal faces of each internal pair of adjacent convolutions of said flexible preformed corrugated metal tubing one of a plurality of semi-resilient spacers, so as to control the radii between said internal faces and to thereby prevent the crushing of said radii when said flexible preformed corrugated metal tubing is subsequently compressed; and (d) compressing said preformed flexible corrugated metal tubing with said nonresilient washers and said semi-resilient spacers inserted therein to a length approximating the total of the wall thicknesses of said convolutions, said nonresilient washers, and said semi-resilient spacers, such that, when said nonresilient washers and said semi-resilient spacers are subsequently removed, said corrugations will have substantially the shape of said nonresilient washers.

2. A method, as defined in claim 1, wherein said preformed corrugated metal tubing is produced by a method which produces said preformed corrugated metal tubing with convolutions having crest and trough radii about 10 times the wall thickness of said preformed corrugated metal tubing.

3. A method, as defined in claim 1, wherein the step of compressing further comprises compressing said preformed corrugated metal tubing to such extent that the crest and trough radii of said corrugated metal tubing are about 1½ to 2 times the wall thickness of said corrugated metal tubing when said corrugated metal tubing is relaxes after compressing.

4. An article of commerce produced by the method of claim 3.

5. A method, as defined in claim 1, further comprising providing said preformed tubing including a plurality of parallel corrugations orthogonal to the major axis of said tubing.

6. A method, as defined in claim 1, further comprising providing each of said nonresilient washers in the form of a pair of hemiannuli.

7. A method, as defined in claim 1, further comprising providing each of said semi-resilient spacers in the form of an annulus.

8. A method, as defined in claim 1, further comprising producing said corrugated tubing having an extension/-compression ration of at least 4:1.

9. A method, as defined in claim 1, further comprising producing said corrugated tubing which can be reversibly compressed to almost the total thicknesses of the metal of which it is formed.

10. A method, as defined in claim 1, further comprising providing said nonresilient washers having a thickness about three times the wall thickness of said corrugated tubing.

11. A method, as defined in claim 1, further comprising providing said semi-resilient washers having a thickness about two times the wall thickness of said corrugated tubing.

12. An apparatus for forming a flexible corrugated metal tubing, having a plurality of corrugations the transverse shape of which is generally a sine wave, from a flexible preformed corrugated metal tubing, said preformed tubing comprising a plurality of corrugations the transverse shape of each of said corrugations having generally a sine wave, and the radii of said corrugations being substantially larger than the corresponding radii of said flexible corrugated tubing, said apparatus comprising:

(a) a housing;

(b) locating means to hold said flexible preformed corrugated metal tubing in said housing;

(c) shaping means to be inserted between the external faces of each pair of external adjacent convolutions in said flexible preformed corrugated metal tubing, each said shaping means having a shape approximating said sine wave shape of the corrugations of said flexible corrugated metal tubing;

(d) semi-resilient means to be inserted between the internal faces of each pair of internal adjacent convolutions in said flexible preformed corrugated metal tubing, so as to control the radii between said internal adjacent convolutions and thereby to prevent the crushing of said radii when said flexible preformed tubing is subsequently compressed; and (e) means to compress said flexible preformed corrugated metal tubing with said shaping means and said resilient means inserted therein to a total length approximating the thicknesses of the convolutions of said flexible preformed corrugated tubing, said shaping means, and said resilient means, such that, when said nonresilient washers and said semi-resilient spacers are subsequently removed, said corrugations will have substantially the shape of said nonresilient washers.

13. An apparatus, as defined in claim 12, wherein the convolutions of said preformed corrugated metal tubing have crest and trough radii about 10 times the wall thickness of said preformed corrugated metal tubing.

14. An apparatus, as defined in claim 12, wherein said means to compress can compress said preformed corrugated metal tubing to such extent that said corrugated metal tubing has crest and trough radii about 1½ to 2 times the wall thickness of said corrugated metal tubing after said corrugated metal tubing is released from said means to compress.

15. An apparatus, as defined in claim 12, wherein said preformed tubing has a major axis and includes a plurality of parallel corrugations orthogonal to the major axis of said tubing.

16. An apparatus, as defined in claim 12, wherein each of said nonresilient washers is in the form of a pair of hemi-annuli.

17. An apparatus, as defined in claim 12, wherein each of said semi-resilient spacers is in the form of an annulus.

18. An apparatus, as defined in claim 12, further such that when said nonresilient washers and said semi-resilient spacers are subsequently removed, said corrugated tubing will have an extension/compression ratio of at least 4:1.

19. An apparatus, as defined in claim 12, further such that when said nonresilient washers and said semi-resilient spacers are subsequently removed, said corrugated tubing can be reversibly compressed to almost the total thicknesses of the metal of which it is formed.

20. An apparatus, as defined in claim 12, wherein said nonresilient washers have a thickness about three times the wall thickness of said corrugated tubing.

21. An apparatus, as defined in claim 12, wherein said semi-resilient washers have a thickness about two times the wall thickness of said corrugated tubing.

22. A flexible corrugated metal tubing, comprising: a plurality of corrugations the transverse shape of which is generally a sine wave, said corrugations having trough and crest radii on the order of from about 1½ to about 2 times the wall thickness of said flexible corrugated metal tubing.

23. A flexible corrugated metal tubing, as defined in claim 22, wherein said flexible corrugated metal tubing has an extension/compression ratio of at least 4:1.

24. A flexible corrugated metal tubing, as defined in claim 22, wherein said flexible corrugated metal and can be reversibly compressed to almost the total thicknesses of the metal of which it is formed.

* * * * *